US011506230B2

(12) United States Patent
Van Ommen et al.

(10) Patent No.: US 11,506,230 B2
(45) Date of Patent: Nov. 22, 2022

(54) ACTUATOR WITH SNUBBER ASSEMBLY

(71) Applicant: Moog BV, Nieuw-Vennep (NL)

(72) Inventors: Herman Van Ommen, Nieuw-Vennep (NL); Jean Paul Warmerdam, Niew-Vennep (NL); Remco Van Der Holst, Nieuw-Vennep (NL)

(73) Assignee: Moog BV, Nieuw-Vennep (NL)

( * ) Notice: Subject to any disclaimer, the term of this patent is extended or adjusted under 35 U.S.C. 154(b) by 0 days.

(21) Appl. No.: 17/262,846

(22) PCT Filed: Jul. 25, 2019

(86) PCT No.: PCT/EP2019/070075

§ 371 (c)(1),
(2) Date: Jan. 25, 2021

(87) PCT Pub. No.: WO2020/021027

PCT Pub. Date: Jan. 30, 2020

(65) Prior Publication Data

US 2021/0190100 A1 Jun. 24, 2021

(30) Foreign Application Priority Data

Jul. 27, 2018 (GB) ..... 1812316

(51) Int. Cl.
*F15B 15/22* (2006.01)

(52) U.S. Cl.
CPC ..... *F15B 15/228* (2013.01); *F15B 15/226* (2013.01); *F15B 15/227* (2013.01)

(58) Field of Classification Search
CPC ..... F15B 15/226; F15B 15/228; F16F 7/003; F16F 7/12
See application file for complete search history.

(56) References Cited

U.S. PATENT DOCUMENTS 1,172,255 A * 2/1916 Buck ..... B60P 1/16 298/22 R
2,948,358 A 8/1960 Born et al.
(Continued)

FOREIGN PATENT DOCUMENTS

CN 105971972 A 9/2016
CN 205744679 U 11/2016
(Continued)

OTHER PUBLICATIONS

International Search Report for PCT/EP2019/070075, completed Oct. 14, 2019, dated Dec. 16, 2019.

*Primary Examiner* — Dustin T Nguyen
*Assistant Examiner* — Michael Quandt
(74) *Attorney, Agent, or Firm* — Harter Secrest & Emery LLP

(57) ABSTRACT

An actuator including a housing, an actuator rod and a snubber assembly. The actuator has an axis, the housing has a first end and an aperture positioned at the first end of the housing, and the actuator rod extends through the aperture along the axis of the actuator. The snubber assembly is mounted at the first end of the housing, and includes one or more energy absorbing devices. The snubber assembly is positioned on the housing such that an axis of each of the one or more energy absorbing devices is offset relative to the axis of the actuator. The snubber assembly is configured such that the one or more energy absorbing devices provide bidirectional end-of-stroke damping.

21 Claims, 8 Drawing Sheets

(56) References Cited

U.S. PATENT DOCUMENTS

| | | | | | |
|---|---|---|---|---|---|
| 5,842,312 | A * | 12/1998 | Krumme | F16F 1/46 | 52/167.1 |
| 6,305,668 | B1 | 10/2001 | Edens | | |
| 9,016,448 | B2 * | 4/2015 | Ludin | F16F 7/125 | 188/377 |
| 2009/0173402 | A1 | 7/2009 | Nalla | | |

FOREIGN PATENT DOCUMENTS

| | | | |
|---|---|---|---|
| DE | 10 2006-041713 | * | 9/2006 |
| EP | 0 327 694 | A1 | 8/1989 |
| EP | 1 375 957 | A1 | 1/2004 |
| EP | 1 710 448 | A1 | 10/2006 |
| JP | H04212986 | A | 8/1992 |
| JP | H10110799 | A | 4/1998 |

* cited by examiner

ACTUATOR WITH SNUBBER ASSEMBLY

The present invention relates to an actuator. More particularly, the present invention relates to an improved actuator including a snubber assembly. The present invention also relates to a simulator or test system or motion system including an improved actuator having a snubber assembly.

It is known for actuators, including hydraulic actuators and electro-mechanical actuators, to be fitted with (separate) snubbing mechanisms to decelerate and reduce or cushion the impact of the actuator rod or piston hitting the end of the cylinder at either end of its stroke.

In some examples of such actuators, a separate snubber assembly is provided at each end of the actuator.

In other systems, for example as described in EP1375957, a single, bidirectional, snubber device may be provided to selectively and controllably decelerate and cushion movement of the piston or actuator rod proximate either end of its stroke.

In each of the above examples, the snubber devices or mechanisms are provided within the actuators. It is not possible to inspect or replace such snubber devices without disassembling the actuator.

According to a first aspect of the invention there is provided an actuator (for example a linear actuator) including a housing, an actuator rod (also referred to as a piston), and a snubber assembly; wherein the snubber assembly is mounted at one end of the housing. Preferably, the actuator has an axis; the housing has a first end and an aperture positioned at the first end of the housing; the actuator rod extends through the aperture along the axis of the actuator; the snubber assembly is mounted at the first end of the housing; the snubber assembly includes one or more energy absorbing devices, and the snubber assembly is positioned on the housing such that an axis of each of the one or more energy absorbing devices is offset relative to the axis of the actuator; and wherein the snubber assembly is configured such that the one or more energy absorbing devices provide bidirectional end-of-stroke damping to motion of the actuator rod. Advantageously, the mounting of the snubber assembly at one end of the housing enables in situ inspection of the snubber assembly without the need to disassemble the actuator and/or the motion system in which the actuator is provided.

The snubber assembly may be mounted on an exterior surface of the actuator such that the snubber assembly is positioned proximal to the one end of the housing.

The offset positioning of the energy absorbing device relative to the actuator housing facilitates the inspection, removal and, if necessary, replacement of the energy absorbing device without the need for disassembly.

The snubber assembly may include a frame that is configured to receive the energy absorbing device.

The frame facilitates the mounting of the snubber assembly on the actuator such that the energy absorbing device can be inspected, removed and replaced without the need to disassemble the actuator and/or a motion system in which the actuator is provided.

The energy absorbing device may be a damper, for example a mechanical damper, elastomeric damper, spring, hydraulic or viscous damper, rubber, crush tube or plastic deformation device. The damper may be a bidirectional end-of-stroke damper, for example operating in actuator extension and/or retraction movements.

In some embodiments, the frame may be configured to receive more than one energy absorbing device.

The frame may include a first frame part and a second frame part. The, or each, energy absorbing device may be positioned between the first frame part and the second frame part.

The first frame part and the second frame part may be moveable, such that the first frame part is moveable relative to the second frame part along the axis of the actuator, and the first frame part and the second frame part are moveable relative to the housing along the axis of the actuator.

The first frame part may include a stop member and a mounting member. In some embodiments, the first frame part mounting member may be configured to receive the energy absorbing device. In other embodiments, the second frame part may be configured to receive the energy absorbing device.

The actuator rod, the housing and the first and second frame parts may have one or more stops. Preferably, the actuator rod has a first end and a second end distal to the first end; the actuator rod comprises a first stop at the first end of the actuator rod and a second stop at the second end of the actuator rod; the housing comprises a third stop at the first end of the housing; the first frame part includes a fourth stop configured to engage with the first stop and a seventh stop configured to engage with the third stop; and the second frame part includes fifth stop configured to engage with the second stop, and a sixth stop configured to engage with the third stop.

The third stop may be positioned between the seventh stop and the sixth stop. Advantageously, this arrangement of stops permits compression of the one or more energy absorbing devices at both extreme ends of the actuator rod stroke, i.e. when the actuator rod is nearly fully extended and nearly fully retracted.

In use, the actuator rod may be extended from the housing to a first predetermined extension distance (for example an almost fully extended position), such that: the second stop is brought into abutting engagement with the fifth stop; the seventh stop abuts the third stop thereby preventing motion of the first frame part in the direction of the extension of the actuator rod; and further extension of the actuator rod causes the second frame part to move in the direction of extension of the actuator rod, thereby compressing the one or more energy absorbing devices between the first frame part and the second frame part.

In use, the actuator rod may be retracted into the housing to a second predetermined extension distance (for example an almost fully retracted position), such that: the first stop is brought into abutting engagement with the fourth stop; the second stop abuts the third stop thereby preventing motion of the second frame part in the direction of the retraction of the actuator rod; and further retraction of the actuator rod causes the first frame part to move in the direction of retraction of the actuator rod, thereby compressing the one or more energy absorbing devices between the first frame part and the second frame part.

In some embodiments, the first frame part comprises a rod linking the fourth stop and the seventh stop. In these embodiments, a first energy absorbing device of the one or more energy absorbing devices may be a crush tube or spring surrounding a portion of the rod, wherein the first energy absorbing device is positioned between the first frame part and the second frame part. The first energy absorbing device may be positioned between the fourth stop and the sixth stop.

In some embodiments, the second frame part includes an eighth stop configured to engage with the one or more energy absorbing devices. In these embodiments, when the actuator rod is extended from the housing to the first predetermined extension distance, preferably: the eighth stop abuts the one or more energy absorbing devices; the further extension of the actuator rod causes compression of the one or more energy absorbing devices between the first frame part and the eighth stop. When the actuator rod is retracted into the housing to the second predetermined extension distance, preferably: the eighth stop abuts the one or more energy absorbing devices; the further retraction of the actuator rod causes compression of the one or more energy absorbing devices between the first frame part and the eighth stop.

The, or each, energy absorbing device may be held within the mounting member, for example by a screw thread or an interference fit. Alternatively, the, or each, energy absorbing device may contact or be connected to the mounting member. The mounting member may be a bushing.

The second frame part may include a housing and a guiding member. The guiding member, for example a rod, may extend between the eighth stop and the second frame member housing. In some examples, a first energy absorbing device of the one or more energy absorbing devices is a crush tube or spring surrounding a portion of the rod, wherein the first energy absorbing device is positioned between the eighth stop and the third stop.

The, or each, energy absorbing device may be held in position by contact with the second frame part stop member. Alternatively, the or each energy absorbing device may be connected to or mounted on the second frame part stop member by, for example, a screw thread or an interference fit.

The second frame member housing may include an opening that is configured to receive the first frame part mounting member.

The actuator may include a ring member. The ring member may be positioned between the fourth stop and the seventh stop.

According to a second aspect of the invention there is provided an actuator including a housing, an actuator rod and a snubber assembly, wherein: the actuator has an axis; the housing has a first end and an aperture positioned at the first end of the housing; the actuator rod extends through the aperture along the axis of the actuator, wherein the actuator rod has an extension range including at least one end-of-stroke extension range; the snubber assembly is mounted at the first end of the housing; the snubber assembly includes one or more energy absorbing devices, and the snubber assembly is positioned on the housing such that an axis of each of the one or more energy absorbing devices is offset relative to the axis of the actuator; the one or more energy absorbing devices are configured to prevent the actuator rod entering the at least one end-of-stroke extension range during controlled operation of the actuator; and the one or more energy absorbing devices are configured to deform, thereby allowing the actuator rod to enter the at least one end-of-stroke extension range, absorbing energy and damping motion of the actuator rod in the event of uncontrolled operation of the actuator.

Advantageously, the mounting of the snubber assembly at one end of the housing enables in situ inspection of the snubber assembly without the need to disassemble the actuator and/or the motion system in which the actuator is provided. Furthermore, during normal/controlled operation this arrangement provides support to the actuator rod (acting as a stop to prevent an actuator rod extending and/or retracting outside an operational stroke, that is prevent the actuator rod entering at least one end-of-stroke portion of its total stroke), whilst ensuring that the actuator rod does not pass through the travel of the snubber assembly and the snubber assembly does not become energised. This reduces wear on the snubber assembly components, thus improving snubber assembly longevity.

Controlled operation of the actuator may correspond to a normal, instructed or desired operation of the actuator. Uncontrolled operation of the actuator may correspond to exceptional, uninstructed or undesired operation of the actuator. For example, uncontrolled operation of the actuator may result from an unexpected load being applied to the actuator, or failure of a component within the system in which the actuator is implemented.

During controlled operation of the actuator, the actuator rod may exert a maximum force on the energy absorbing device less than a threshold force. During uncontrolled operation of the actuator, the actuator rod may exert a maximum force on the energy absorbing device equal to or greater than the threshold force. Preferably the one or more energy absorbing devices are configured to deform when a force equal to or greater than the threshold force is applied to the one or more energy absorbing devices.

By positioning the at least one energy absorbing devices with their axes offset with respect to the axis of the actuator, the snubber assembly can accommodate different numbers and dimensions of energy absorbing devices. Thus the snubber assembly can be easily tailored to the application of the actuator. For example, the number/type/material of energy absorbing devices can be chosen to give an appropriate threshold force and overall snubber assembly size for the specific application of the actuator. This arrangement is thus easily adaptable to different applications.

Each of the at least one energy absorbing devices may be a crush tube. For example a tube of plastically deformable material (e.g. steel, aluminium, or engineering plastic). The number/material/thickness of the crush tube(s) can be chosen to give an appropriate threshold force and overall snubber assembly size for the specific application of the actuator. Moreover, by positioning the at least one crush tubes with their axes offset with respect to the axis of the actuator, they can be easily replaced if they become deformed during use. It is noted that replacement of a crush tube surrounding a portion of an actuator rod (i.e. a crush tube that does not have an offset axis with respect to the actuator rod) requires disassembly of the actuator itself, and is thus time consuming and difficult.

The snubber assembly may be configured to provide bidirectional end-of-stroke damping such that: the one or more energy absorbing devices are configured to prevent the actuator rod entering a first end-of-stroke extension range corresponding to an extended position of the actuator rod (e.g. an almost fully extended position) and a second end-of-stroke extension range corresponding to a retracted position of the actuator rod (e.g. an almost fully retracted position) during controlled operation of the actuator; and the one or more energy absorbing devices are configured to deform, thereby allowing the actuator rod to enter either the first end-of-stroke extension range or the second end-of-stroke extension range in the event of uncontrolled operation of the actuator.

Alternatively, the snubber assembly may be configured to provide mono-directional end-of-stroke damping such that: the one or more energy absorbing devices are configured to prevent the actuator rod entering a first end-of-stroke extension range corresponding to an extended position of the actuator rod (e.g. an almost fully extended position) and the one or more energy absorbing devices are configured to deform, thereby allowing the actuator rod to enter the first end-of-stroke extension range in the event of an uncontrolled operation of the actuator.

The snubber assembly may include a frame that is configured to receive the one or more energy absorbing devices, wherein the frame includes a first frame part and a second frame part, and the one or more energy absorbing devices are positioned between the first frame part and the second frame part. The first frame part may be moveable relative to the second frame part along the axis of the actuator. The first frame part and the second frame part may be moveable relative to the housing along the axis of the actuator.

Preferably: the actuator rod has a first end and a second end distal to the first end; the actuator rod comprises a first stop at the first end of the actuator rod and a second stop at the second end of the actuator rod; the housing comprises a third stop at the first end of the housing; the first frame part includes a fourth stop configured to engage with the first stop and a seventh stop configured to engage with the third stop; and the second frame part includes fifth stop configured to engage with the second stop, and a sixth stop configured to engage with the third stop. The third stop may be positioned between the seventh stop and the sixth stop. Advantageously, this arrangement of stops permits deformation/compression of the one or more energy absorbing devices at both extreme ends of the actuator rod stroke, i.e. when the actuator rod is nearly fully extended and nearly fully retracted.

In use, the actuator rod may be extended from the housing to a first predetermined extension distance (for example an almost fully extended position), such that: the second stop is brought into abutting engagement with the fifth stop; the seventh stop abuts the third stop thereby preventing motion of the first frame part in the direction of the extension of the actuator rod; further extension of the actuator rod during uncontrolled operation causes the second frame part to move in the direction of extension of the actuator rod, thereby compressing and deforming the one or more energy absorbing devices between the first frame part and the second frame part.

In use, the actuator rod may be retracted into the housing to a second predetermined extension distance (for example an almost fully retracted position), such that: the first stop is brought into abutting engagement with the fourth stop; the second stop abuts the third stop thereby preventing motion of the second frame part in the direction of the retraction of the actuator rod; further retraction of the actuator rod during uncontrolled operation causes the first frame part to move in the direction of retraction of the actuator rod, thereby deforming and compressing the one or more energy absorbing devices between the first frame part and the second frame part.

According to a third aspect of the invention there is provided a simulator or test system including a base, a platform that is mounted for movement relative to the base, and an actuation mechanism that is operatively arranged between the base and the platform, wherein the actuation mechanism includes at least one actuator as defined by the first aspect of the invention.

Embodiments of the invention will now be described with reference to the accompanying drawings, in which.

Figure 1:
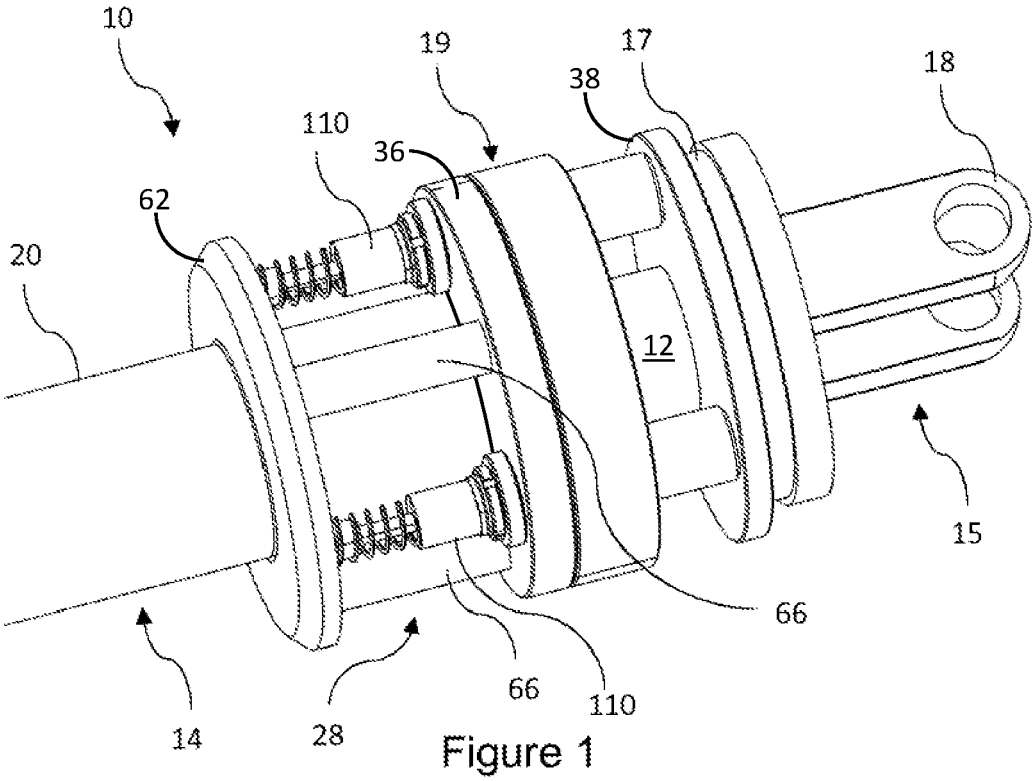
FIG. 1 is a partial perspective view of an actuator according to a first embodiment of the invention.

With reference to FIGS. 1 to 5, there is shown an actuator 10 according to a first embodiment of the present invention. The actuator 10 has an axis (for example a central axis) 11. The actuator 10 is a linear actuator, which may for example be a hydraulic actuator or an electromechanical actuator, has a piston (also referred to as an actuator rod) 12 and a housing or cylinder member 14.

The actuator 10 preferably comprises conventional means for driving the actuator rod or piston 12 such that the actuator rod 12 can be extended from, and retracted within the housing 14 along the axis 11.

The piston or actuator rod 12 is generally cylindrical and has a first end 15 and a second end 16. In the case of an actuator rod for an electromechanical actuator, preferably a helical thread (not shown) is provided on the circumference of the actuator rod. A stop 17 and a clevis joint 18 are provided at the first end 15 of the actuator rod/piston 12.

The housing 14 has a generally cylindrical hollow body having a first end 19, a second end (not shown) and an outer wall 20. The first end 19 includes an aperture 13 through which the actuator rod extends and retracts during operation. The outer wall 20 has an exterior surface 22 and an interior surface 24. The outer wall 20 defines a cavity 26. A stop (not shown) and a clevis joint (not shown) are provided at the second end (not shown) of the housing 14.

The actuator rod or piston 12 has a flange or stop 21, the flange 21 being positioned at the second end 16 of the piston/actuator rod 12 and having a first surface 27.

The actuator 10 also has a snubber or buffer or damper assembly 28. The snubber assembly is positioned proximate to the first end 19 of the housing 14, and is configured to provide bi-directional damping (that is to say damp end-of-stroke motion of the actuator rod or piston 12 during extension and retraction) without the need for further damping means provided proximate to the second end of the housing 14. In some examples a snubber assembly 28 is only provided at the first end 19 of the housing 14 (for example, no further snubber/buffer/damper assembly is provided elsewhere on or within the housing 14).

The snubber assembly 28 will be described with particular reference to FIGS. 2, 3, 4 and 5.

The snubber assembly 28 has a frame 30. The frame 30 includes a first frame part 32, a second frame part 34 and a ring member or buffer guidance ring 36.

The first frame part 32 includes a stop member or buffer top ring 38 and a mounting member in the form of a bushing or buffer bushing 40.

The stop member 38 is ring-shaped and has a first face 42, a second face 44, an outer surface 46 and a central aperture 47.

The bushing 40 is generally cylindrical and has a first end 48, a second end 50 and an elongate body 52. The second end 50 has a flange 54 with an opening 56. The elongate body 52 is hollow and has an outer surface 58 and a cavity 60.

The second frame part 34 includes a stop member or bottom buffer ring 62, a second frame part housing 64 and guiding member for example in the form of a rod or guidance rod 66.

The stop member 62 is ring-shaped and has a first face 68, a second face 70, an outer surface 72 and a central aperture 73.

The second frame part housing 64 has a first end 74, a second end 76, an outer surface 78 and a central aperture 79. The second frame part housing 64 includes a generally cylindrical body 96 proximal to the second end 76 and a flange portion 98 proximal to the first end 74.

The generally cylindrical body 96 has an inner surface 100 and an outer surface 102.

The flange portion 98 has a first face 104, a second face 106 and a through-hole 108.

The guidance rod 66 is generally cylindrical and has a first end 80, a second end 82 and an elongate body 84. Optionally, a spring (not shown) or a crush tube (not shown) may be positioned around at least one of the guidance rods 66 so as to store/absorb energy during compression of the snubber assembly 28. The material and thickness of such a crush tube can be chosen according to the desired energy absorption characteristic of the snubber assembly 28 for the particular application for which the actuator 10 is used. The crush tube can be made of any material exhibiting plastic deformation properties and suitable crush characteristics. Preferred materials for the crush tube include stainless steel, aluminium and engineering plastic.

Crush tubes typically require at least a threshold force to be applied along their axis before they collapse. In embodiments in which a crush tube is positioned around the guidance rods 66, the material and thickness of the crush tube is preferably selected such that it can support the actuator rod 12 during normal operation. In other words, the crush tube is configured to have a threshold force for collapsing that is higher than the force typically exerted by the actuator 10 during normal operation. This prevents the actuator rod 12 reaching the extreme ends of its extension and retraction strokes without energising the snubber assembly 28 during normal operation. Put differently, the actuator 10 has an operational stroke that does not include end-of-stroke portions, and the crush tube acts as a stop that prevents the actuator rod 12 entering the end-of-stroke portions (i.e. extending or retracting outside its operational stroke) during normal or controlled operation. In such embodiments, the snubber assembly 28 is only compressed and energised when the forces applied to the snubber assembly 28 are sufficient to cause the crush tubes to collapse, such events only occurring outside of normal operation.

The ring member 36 is generally cylindrical and has a first face 86, a second face 88, an outer surface 90 and a central aperture 91. A plurality of apertures or holes 92, 94 extend between the first face 86 and the second face 88.

The snubber assembly 28 is assembled on the actuator 10 as follows.

The ring member 36 is circumferentially fixed on the exterior surface 22 of the wall 20 of the housing 14. The ring member 36 is positioned proximal to the first end 19 of the housing 14. The ring member 36 may, for example, be fixed or fastened to the exterior surface 22 of the housing 14 by a screw thread.

The housing 64 of the second frame part 34 is positioned on the outside of the housing 14 such that the outer surface 102 of the generally cylindrical body 96 of the second frame part housing 64 is positioned adjacent to the interior surface 24 of the wall 20 of the housing 14. The second frame part housing 64 is then positioned such that the through-hole 108 of the flange portion 98 of the second frame part housing 64 is aligned with the aperture 92 in the ring member 36.

The bushing 40 is mounted though the aperture 94 in the ring member 36 and through the through-hole 108 of the flange portion 98 of the second frame part housing 64 such that the flange 54 of the bushing 40 abuts the second face 88 of the ring member 36.

The stop member 38 of the first frame part 32 is fixed to the first end 48 of the bushing 40.

The guidance rod 66 of the second frame part 34 is passed through the aperture 92 in the ring member 36 and the through-hole 108 of the flange portion 98 and fixed in position.

An energy absorbing, shock absorbing, damping or kinetic energy absorbing device, such as a snubber or buffer or damper, 110 is mounted in the cavity 60 of the bushing 40. The snubber 110 has a first end 111. The snubber or damper 110 may be held in position in the cavity 60 by a screw thread or an interference fit, for example. In alternative embodiments, contact between the snubber or damper 110 and the bushing 40 may hold the snubber or damper 110 in position.

The stop member 62 is fixed to the first end 80 of the second frame part 34 such that the snubber 110 is supported in position between the stop member 62 and the second frame part housing 64. The snubber or damper 110 may be held in position by contact with the stop member 62. In alternative embodiments, the snubber or damper 110 may be held in position relative to the stop member 62 by a screw thread or an interference fit, for example.

In this way, the ring member 36 is circumferentially fixed with respect to the housing 14 and each of the first frame member 32 and the second frame member 34 are able to move circumferentially with respect to the housing 14.

Operation of the actuator 10 will now be described with particular reference to FIGS. 2, 3, 4 and 5.

Figure 2:
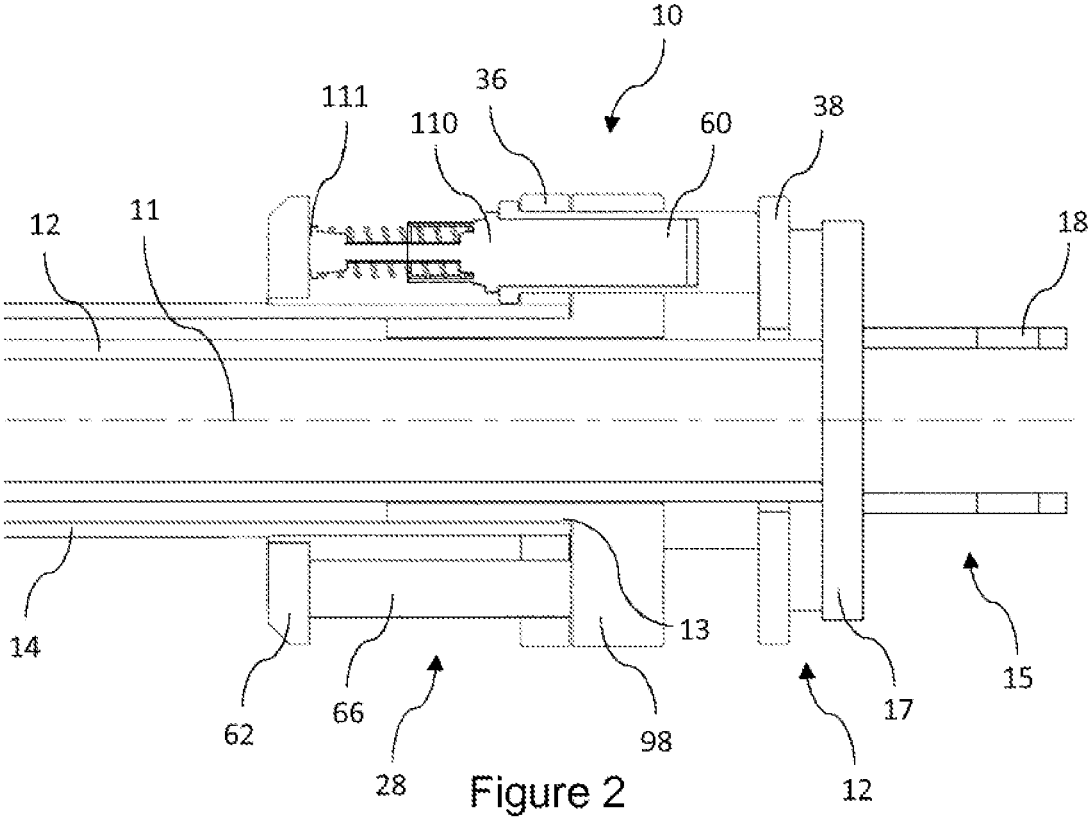
FIG. 2 is a partial section view of an actuator according to the first embodiment of invention with the snubbing device in a first, neutral, position.

FIG. 2 shows the actuator 10 in a neutral (or "settled") position. In this position, the actuator rod/piston 12 is retracted such that the first end 15 of the piston is proximate or abutting the snubber assembly 28, but is not retracted to such an extent that the snubber assembly is compressed. Consequently the snubber assembly 28 is not energised in the settled position shown in FIG. 2.

Figure 3:
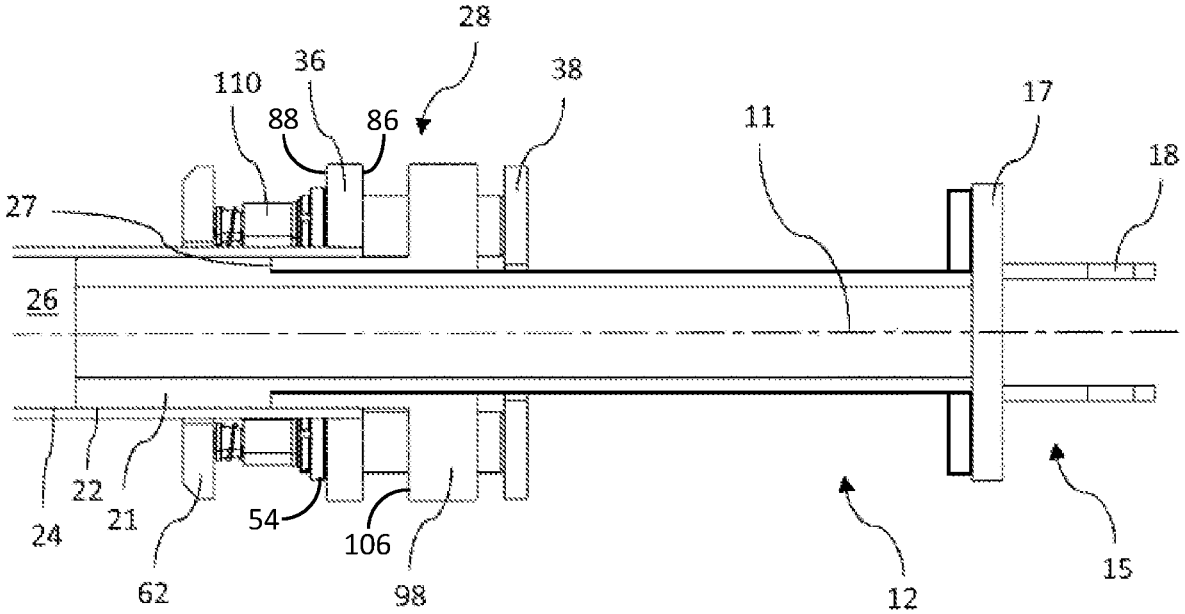
FIG. 3 is partial section view of an actuator according to the first embodiment of the invention with the snubbing device in a second, extended, position.
Figure 4:
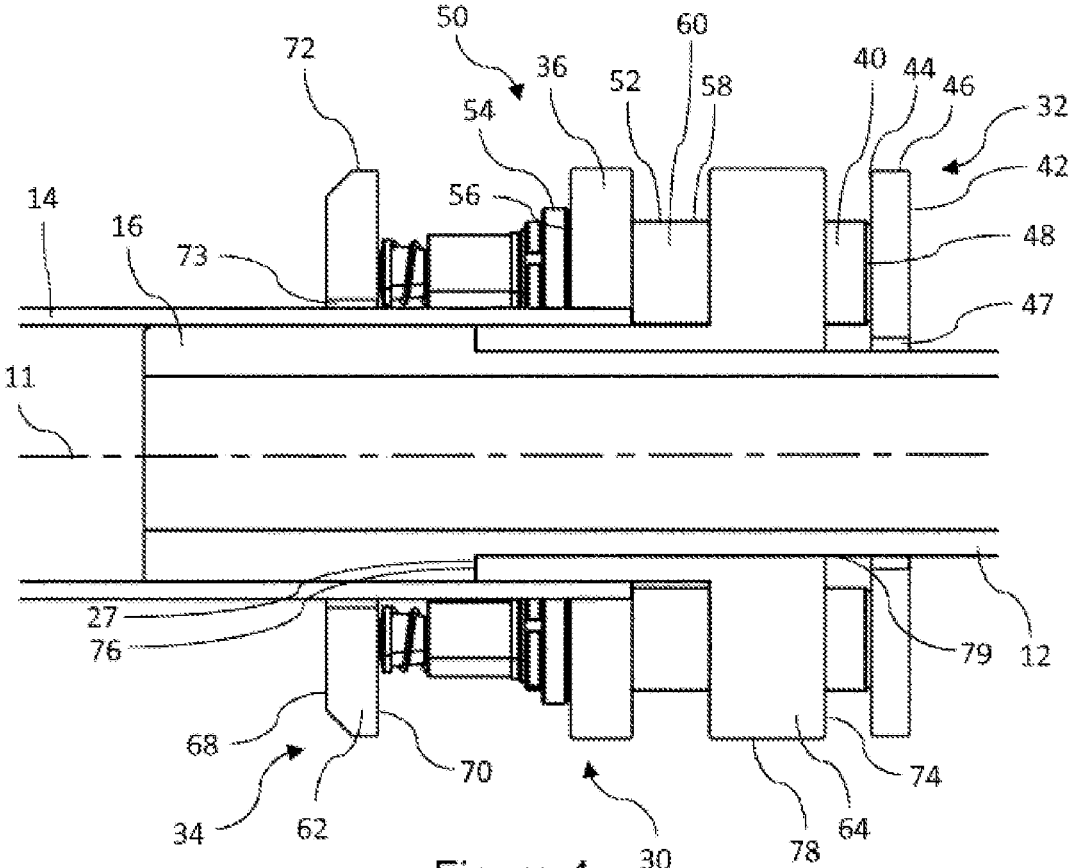
FIG. 4 is an alternative partial section view of an actuator according to the first embodiment of the invention with the snubbing device in the second, extended, position.

FIGS. 3 and 4 show the actuator 10 in an extended position, with the second end 16 of the actuator rod/piston 12 proximal to the first end 19 of the housing 14.

In this position, the stop member 38 of the first frame part 32 is spaced apart from the stop 17 of the actuator rod/piston 12. The stop/flange 21 of actuator rod/piston 12 abuts the housing 64 of the second frame part 34, such that the first surface 27 of the flange/stop 21 is in contact with the second end 76 of the second frame part 34.

The snubber 110 is compressed such that the flange 54 at the second end 50 of the bushing 40 is in abutting engagement with the second face 88 of the ring member 36 and the first face 86 of the ring member 36 is spaced apart from the second face 106 of the flange portion 98 of the second frame part 34.

Figure 5:
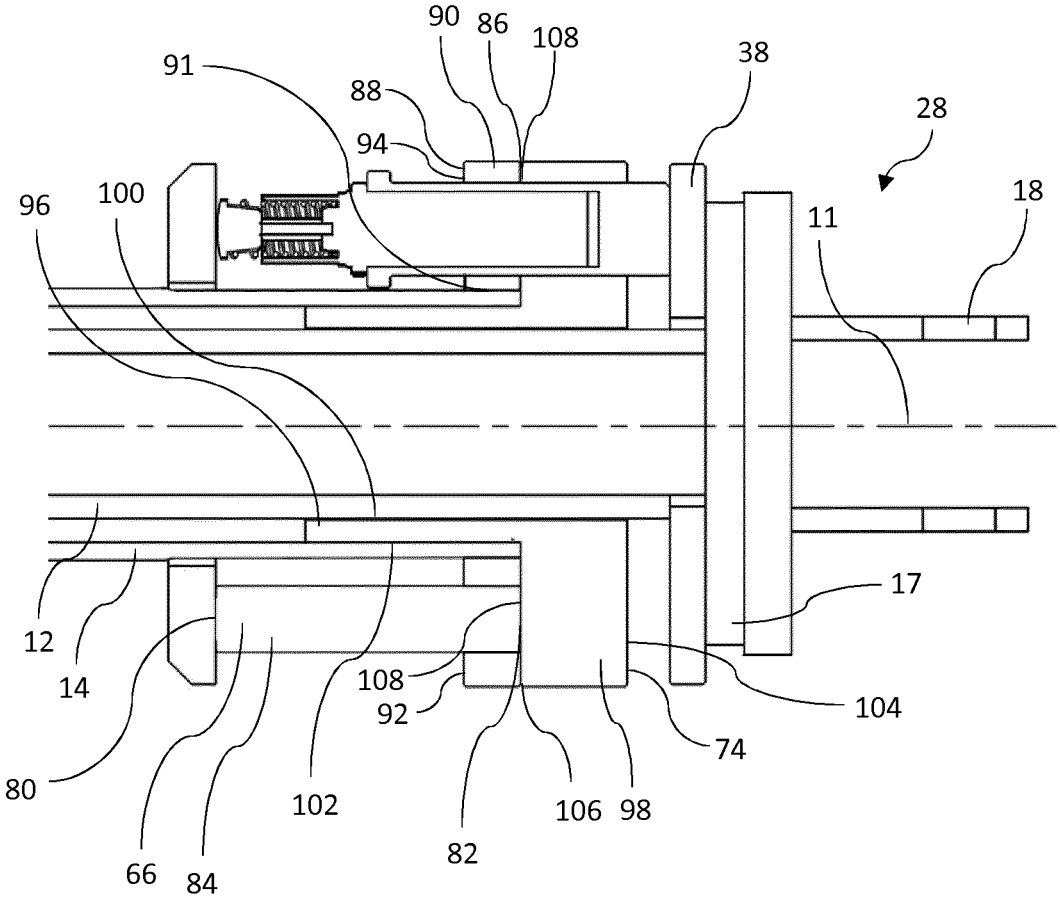
FIG. 5 is a partial section view of an actuator according to the first embodiment of the invention with the snubbing device in a third, retracted, position.

FIG. 5 shows the actuator 10 in a retracted position, with the first end 15 of the actuator rod/piston 12 proximal to the first end 19 of the housing 14. The actuator rod/piston 12 is retracted to a greater extent than shown in FIG. 2, such that the snubber 28 is compressed (and therefore energised) as discussed below.

The first end 111 is pushed against the second face 70 of the stop member 62 of the second frame part 34, such that the snubber 110 is compressed against the second face 70 of the stop member 62 of the second frame part 34. The flange 54 at the second end 50 of the bushing 40 is spaced apart from the second face 88 of the ring member 36 and the first face 86 of the ring member 36 is in abutting engagement with the second face 106 of the flange portion 98 of the second frame part 34.

During normal operation of the actuator 10, the actuator rod/piston 12 moves within the housing 14 as the actuator 10 extends and contracts. As the ring member 36 is circumferentially fixed with respect to the exterior surface 22 of the wall 20 of the housing 14, the position of the snubber assembly 28 relative to the first end 15 of the actuator rod/piston 12 changes as the position of the first end 15 of the actuator rod/piston 12 changes relative to the first end 19 of the housing 14.

When the actuator 10 is in a neutral (or "settled") position as shown in FIG. 2 (neither fully extended nor fully compressed), the snubber 110 is not compressed.

The flange 54 at the second end 50 of the bushing 40 is in abutting engagement with the second face 88 of the ring member 36 and the first face 86 of the ring member 36 is in abutting engagement with the second face 106 of the flange portion 98 of the second frame part 34.

The first frame part 32 and the second frame part 34 are able to move circumferentially with respect to the housing 14.

In the event of a sudden expansion of the actuator 10 such that the actuator 10 is in the extended position shown in FIGS. 3 and 4, the first surface 27 of the flange/stop 21 at the second end 16 of the actuator rod/piston 12 pushes against the second end 76 of the housing 64 of the second frame part 34. In this situation, the snubber 110 absorbs energy and cushions the movement of the actuator 10 by being compressed such that the flange 54 at the second end 50 of the bushing 40 is in abutting engagement with the second face 88 of the ring member 36 and the first face 86 of the ring member 36 is spaced apart from the second face 106 of the flange portion 98 of the second frame part 34.

Similarly, in the event of a sudden compression of the actuator 10 such that the actuator 10 is in the retracted position shown in FIG. 5, the snubber 110 absorbs energy and cushions the movement of the actuator 10 by being compressed against the second face 70 of the stop member 62 of the second frame part 34. The flange 54 at the second end 50 of the bushing 40 is spaced apart from the second face 88 of the ring member 36 and the first face 86 of the ring member 36 is in abutting engagement with the second face 106 of the flange portion 98 of the second frame part 34.

In this way, the snubber assembly 28 provides bidirectional end-of-stroke damping. Put differently, the snubber assembly 28 damps motion of the actuator rod/piston 12 at both ends of its stroke—when nearly fully extended, further extension of the actuator rod 12 from the housing 14 is damped, and when nearly fully retracted further retraction of the actuator rod 12 into the housing 14 is damped.

With reference to FIGS. 6 to 11, there is shown an actuator 210 according to a second embodiment of the present invention. The actuator 210 has an axis (for example a central axis) 211. The actuator 210 is a linear actuator, which may for example be a hydraulic actuator or an electromechanical actuator, has a piston or actuator rod 212 and a housing or cylinder member 214. The actuator 210 preferably comprises conventional means for driving the actuator rod or piston 212 such that the actuator rod can be extended from, and retracted within the housing 214 along the axis 211.

Figure 6:
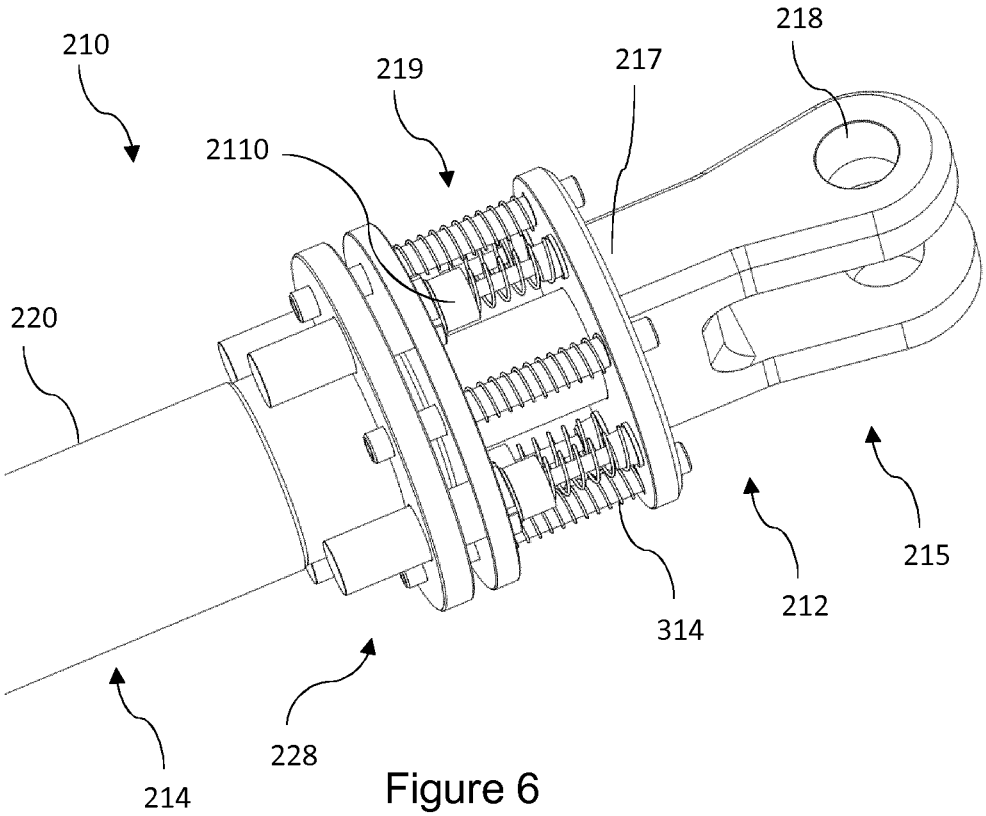
FIG. 6 is a partial perspective view of an actuator according to a second embodiment of the invention.
Figure 7:
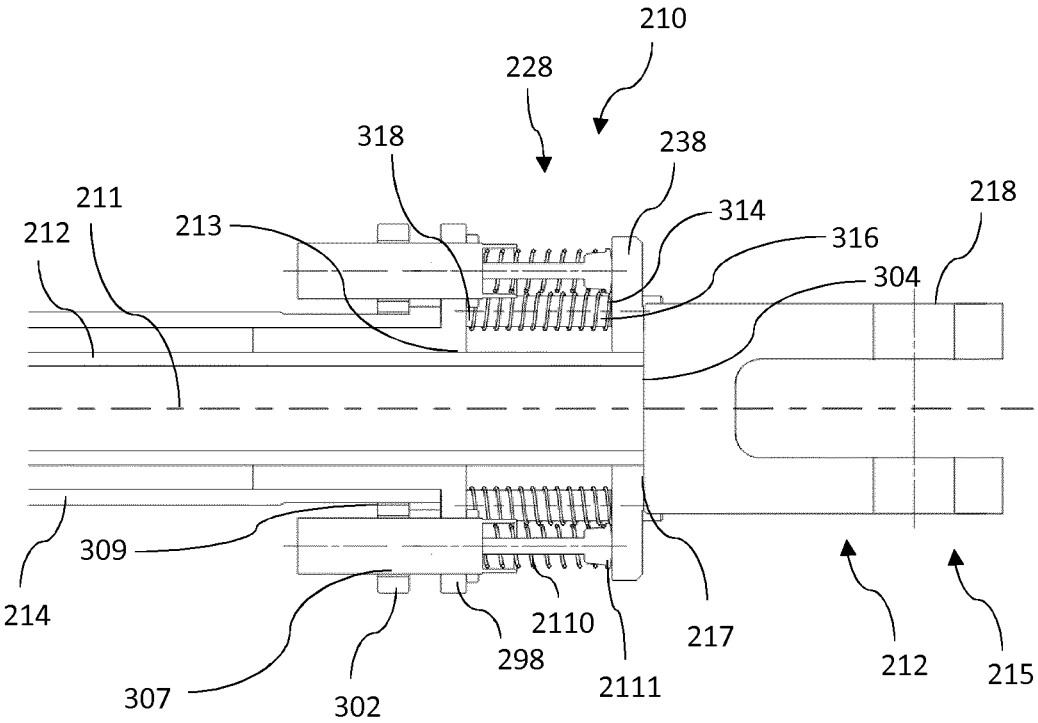
FIG. 7 is a partial section view of an actuator according to the second embodiment of invention with the snubbing device in a first, neutral, position.
Figure 8:
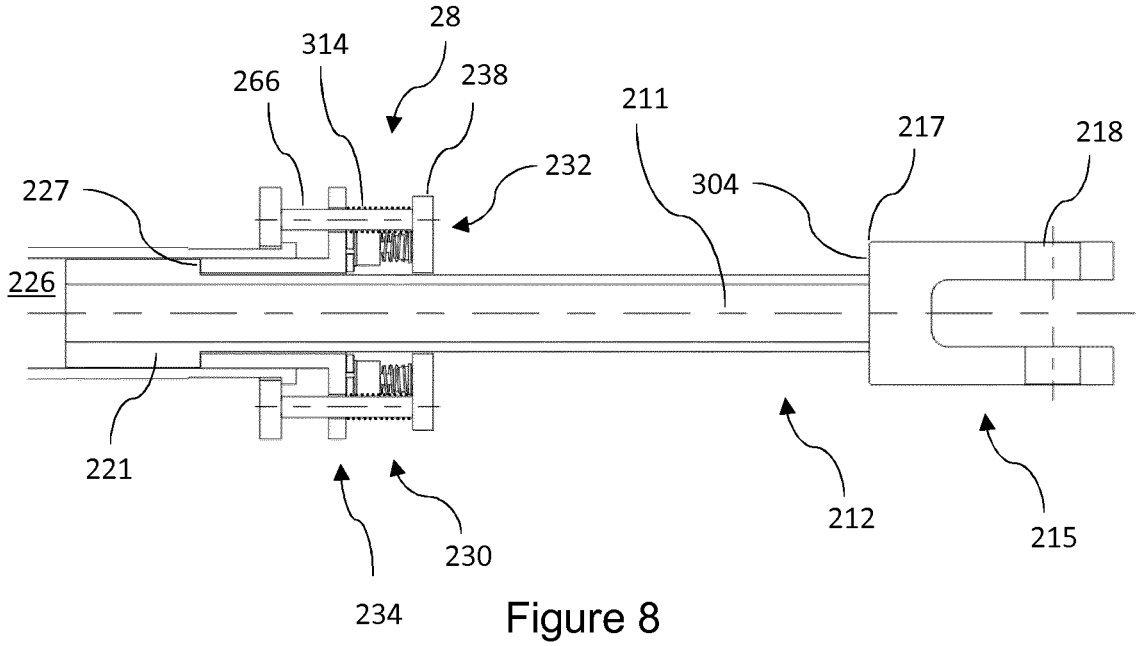
FIG. 8 is partial section view of an actuator according to the second embodiment of the invention with the snubbing device in a second, extended, position.

The actuator rod/piston 212 is generally cylindrical and has a first end 215 and a second end 216. A stop 217 and a clevis joint 218 are provided at the first end 215 of the actuator rod/piston 212. As shown in FIGS. 6, 7 and 8, the stop 217 is a surface 300 of the clevis joint 218, however it will be understood that a separate stop member may be provided attached to the actuator rod/piston 212 proximate the first end 215.

The housing 214 has a generally cylindrical hollow body having a first end 219, a second end (not shown) and an outer wall 220. The first end 219 includes an aperture 213 through which the actuator rod extends and retracts during operation. The outer wall 220 has an exterior surface 222 and an interior surface 224. The outer wall 220 defines a cavity 226. A stop (not shown) and a clevis joint (not shown) are provided at the second end (not shown) of the housing 214.

The actuator rod or piston 212 has a flange or stop 221 the flange 221 being positioned at the second end 216 of the piston/actuator rod 212 and having a first surface 227.

The actuator 210 also has a snubber or buffer or damper assembly 228. The snubber assembly is positioned proximate to the first end 219 of the housing 214, and is configured to provide bi-directional damping (that is to say damp end-of-stroke motion of the piston/actuator rod 212 during extension and retraction) without the need for further damping means provided proximate to the second end of the housing 214. In some examples a snubber assembly 228 is only provided at the first end 219 of the housing 214 (for example, no further snubber/buffer/damper assembly is provided elsewhere on or within the housing 214).

The snubber assembly 228 will be described with particular reference to FIGS. 7, 8, 9, 10 and 11.

The snubber assembly 228 (also referred to, for example, as a buffer assembly or damper assembly) includes a frame 230. The frame 230 includes a first frame part 232 and a second frame part 234.

The first frame part 232 includes a first stop member or buffer top ring 238. The first stop member 238 is ring-shaped and has a first face 242, a second face 244, an outer surface 246 and a central aperture 247.

The first frame part 234 includes a second stop member or bottom buffer ring 302, a guiding member for example in the form of a rod or guidance rod 266, and an energy absorbing and/or storing element 314. The second stop member 302 is ring-shaped and has a first face 304, a second face 306, an outer surface 308, a through-hole 307 extending between the first face 3-4 and the second face 306, and a central aperture 309.

The guidance rod 266 is generally cylindrical and has a first end 280, a second end 282 and an elongate body 284.

Energy absorbing and/or storing element 314 has a first end 316 and a second end 318. As shown in FIGS. 6 to 9, energy absorbing and/or storing element 314 is shown as a spring, however in alternative embodiments, the energy absorbing and/or storing element 314 is a crush tube.

The outer wall 220 includes a flange 312 at the first end 219. The flange has an outer diameter greater than the inner diameter of the central aperture 309 of second stop 302. The outer wall 220 also includes a portion 310 abutting the flange 312 having an outer diameter that is: smaller than the outer diameter of the flange 312; and smaller or equal to the inner diameter of the central aperture 309 of the second stop 302.

The second frame part 236 includes a second frame part housing 264. The second frame part housing 264 has a first end 274, a second end 276, an outer surface 278 and a central aperture 279. The second frame part housing 264 includes a generally cylindrical body 296 proximal to the second end 276 and a flange portion 298 proximal to the first end 274.

The generally cylindrical body 296 has an inner surface 2100 and an outer surface 2102.

The flange portion 298 has a first face 2104, a second face 2106, a through-hole 320, and an aperture 322.

The snubber assembly 228 is assembled on the actuator 210 as follows.

Second stop member 302 of the first frame part 232 is positioned over the housing 214, such that the portion 310 of the housing 214 extends through the central aperture 309 of the second stop member 302 and the flange 312 is between the second stop 302 and the first end 215 of the piston/actuator rod 212. This may be achieved in a number of ways. Preferably the flange 312 is provided with a threaded portion (not shown) configured to engage with a corresponding thread (not shown) on the interior surface 224 of housing 212. In this case, during fabrication the portion 310 of the housing 214 is inserted through the central aperture 309 of the second stop member 302, and the flange 309 is screwed onto the housing 214 by means of the corresponding threads. In an alternative example, flange 312 can be formed by a snap ring mounted in a suitable groove around the housing 214 thereby providing a stop limiting the extent to which the second stop member 302 can move in the extension direction of the actuator rod 212 (i.e. to the right as shown in FIGS. 7 to 10), but not limiting movement of the second stop member 302 in the retraction direction of the actuator rod 212 (i.e. to the left as shown in FIGS. 7 to 10).

The housing 264 of the second frame part 234 is positioned on the outside of the housing 214 such that the outer surface 2102 of the generally cylindrical body 96 of the second frame part housing 264 is positioned adjacent to the interior surface 224 of the wall 220 of the housing 214. Preferably, during fabrication, actuator rod 212 is placed within housing 214, and second stop 302 is positioned around housing 214, prior to inserting the generally cylindrical body 96 of the second frame part housing 264 within the housing 212.

The guidance rod 266 is passed through the through-hole 320 in the flange 298 of the second frame part housing 264, and fixed to the second stop member 302. For example, the guidance rod 266 may be fixed to the second stop member 302 by means of a threaded bolt (not shown) passed through a clearance hole (not shown) in the second stop 302 and configured to engage with a threaded cavity (not shown) in the guidance rod 266.

The energy absorbing/storing element 314 (for example a spring or crush tube) is placed over the guidance rod 266 (subsequent to the guidance rod 266 being passed through the flange 298), such that a portion of the guidance rod 266 extends within the energy absorbing/storing element 314.

An energy absorbing, shock absorbing, damping or kinetic energy absorbing device, such as a snubber or buffer or damper, 2110 is mounted in the aperture 322 of the flange 298 of the second frame part housing 264. The snubber has a first end 2111. In one example, the snubber 2110 is provided with a thread on an outer surface (not shown) which is screwed into a corresponding thread (not shown) on an interior surface of the aperture 322. The snubber 2110 is aligned with through-hole 307 of the second stop member 302.

The first stop member 238 is fixed to the guidance rod 266 (subsequent to the snubber 2110 being fixed to the flange 298 of the second frame part housing 264). For example, the guidance rod 266 may be fixed to the first stop member 238 by means of a threaded bolt 324 passed through a clearance hole 326 in the first stop member 238 and configured to engage with a threaded cavity (not shown) in the guidance rod 266.

In this way, each of the first frame member 232 and the second frame member 234 are able to move circumferentially with respect to the housing 214.

Once the snubber assembly 228 has been assembled, the stop 217 and clevis joint 218 are fixed to the actuator rod/piston 212.

Operation of the actuator 10 will now be described with particular reference to FIGS. 7, 8, 9 and 10.

FIG. 7 shows the actuator 210 in a neutral (or "settled") position. In this position, the actuator rod/piston 212 is retracted such that the first end 215 of the piston is proximate or abutting the snubber assembly 228, but is not retracted to such an extent that the snubber assembly is compressed. Consequently the snubber assembly 228 is not energised in the settled position shown in FIG. 7.

Figure 9:
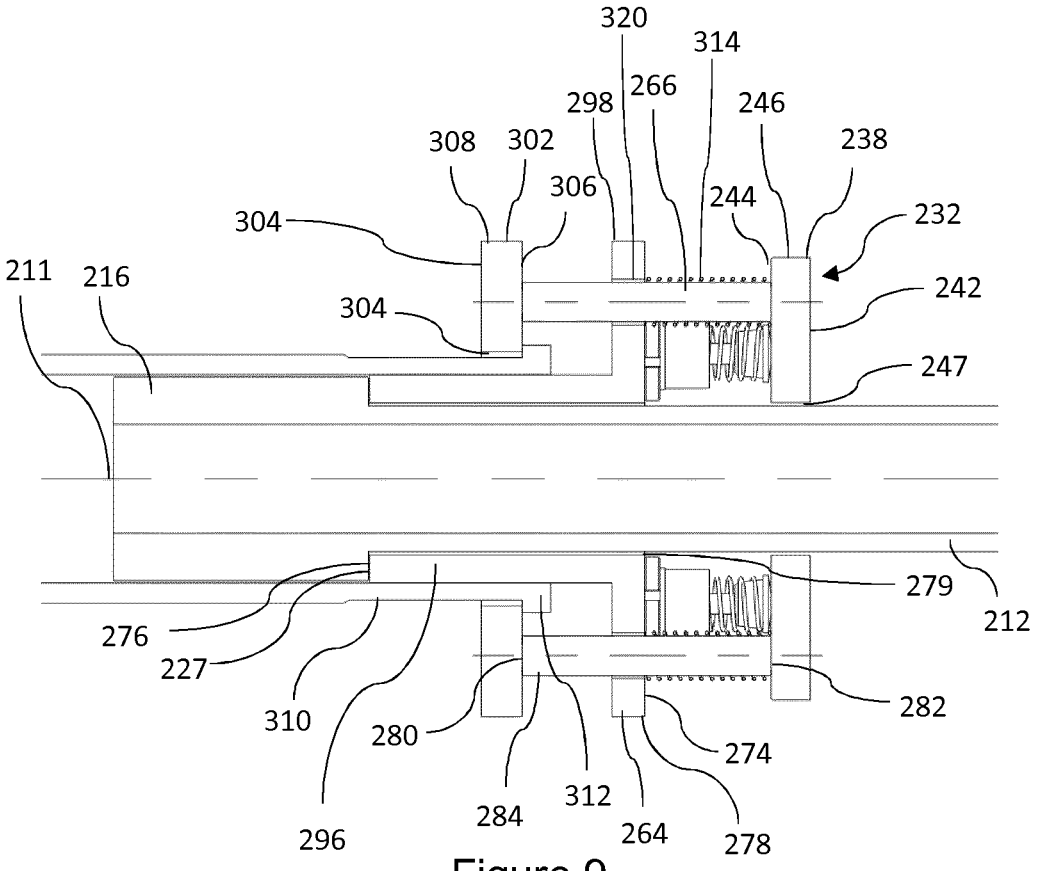
FIG. 9 is an alternative partial section view of an actuator according to the second embodiment of the invention with the snubbing device in the second, extended, position.

FIGS. 8 and 9 show the actuator 210 in an extended position, with the second end 216 of the actuator rod/piston 212 proximal to the first end 219 of the housing 214.

In this position, the stop member 238 of the first frame part 232 is spaced apart from the stop 217 of the actuator rod/piston 212. The stop/flange 221 of actuator rod/piston 212 abuts the housing 264 of the second frame part 234, such that the first surface 227 of the flange/stop 221 is in contact with the second end 276 of the second frame part 234.

In this position, the first stop member 238 is prevented from moving in the extension direction of the actuator rod/piston 212 (i.e. to the right with respect to the orientation shown in FIGS. 8 and 9) due to its connection to the second stop member 302 by means of the guidance rods 266: the second stop member 302 is prevented from moving in the extension direction of the actuator rod/piston 212 by the flange 312 of the housing 214.

Accordingly, due to the stop/flange 221 of actuator rod/piston 212 pushing against the second frame part 234, the first end 2111 of the snubber 2110 pushes against the second face 244 of the first stop member 238, with the result that the snubber 2110 is compressed between flange 298 of the second frame part 234 and the first stop member 238. As shown in FIGS. 8 and 9, a portion of the snubber 2110 extends through through-hole 307 in the second stop member 302.

Preferably, the energy absorbing/storing element 314 is dimensioned so as to be equal to or less than the distance between the first end 274 of the second frame part housing 264 and the second face 244 of the first stop member 238 when the actuator is in a settled or neutral position. Accordingly, in the extended position shown in FIGS. 8 and 9, the energy absorbing/storing element 314 is compressed between the first end 274 of the second frame part housing 264 and the second face 244 of the first stop member 238.

As shown in FIGS. 8 and 9, the energy absorbing/storing element 314 is a spring, which at least partially stores energy during compression.

Alternatively, energy absorbing/storing element 314 is a crush tube (made from a plastically deformable material such as steel, aluminium or engineering plastic). In this case, the crush tube 314 deforms under compression between the first end 274 of the second frame part housing 264 and the second face 244 of the first stop member 238, thus absorbing energy. It will be understood that if crush tubes are provided, compression and thus deformation of the crush tubes will necessitate their replacement. Advantageously, the snubber assembly 228 as described above can be easily disassembled in situ on the actuator 210, facilitating easy removal and replacement of crush tubes (e.g. by simply extending the actuator and removing the first stop 238 from guidance rods 266). This is beneficial over actuators in which a crush tube is provided surrounding a central actuator rod or piston, wherein replacement of the crush tube requires the actuator itself to be disassembled.

As noted above, crush tubes typically require at least a threshold force to be applied along their axis before they collapse. In embodiments in which the energy absorbing/storing element 314 is a crush tube, the material and thickness of the crush tube is preferably selected such that it can support the actuator rod 212 during normal operation. In other words, the crush tube is configured to have a threshold force for collapsing that is higher than the force typically exerted by the actuator 210 during normal operation. This prevents the actuator rod 212 reaching the extreme ends of its extension and retraction strokes without energising the snubber assembly 228 during normal operation. Put differently, the actuator 210 has an operational stroke that does not include end-of-stroke portions, and the crush tube acts as a stop that prevents the actuator rod 212 entering the end-of-stroke portions (i.e. extending or retracting outside its operational stroke) during normal or controlled operation. In such embodiments, the snubber assembly 228 is only compressed and energised when the forces applied to the snubber assembly 228 are sufficient to cause the crush tubes to collapse, such events only occurring outside of normal operation.

Figure 10:
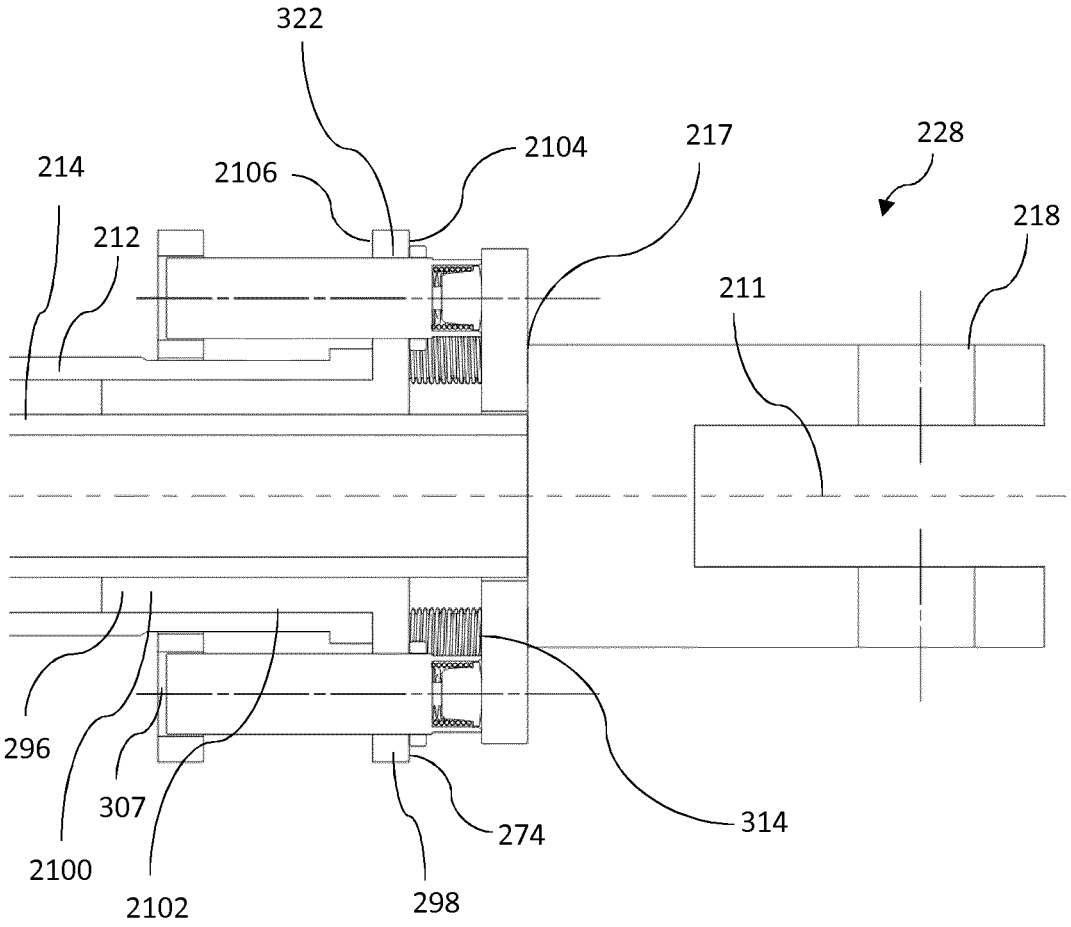
FIG. 10 is a partial section view of an actuator according to the second embodiment of the invention with the snubbing device in a third, retracted, position.
Figure 11:
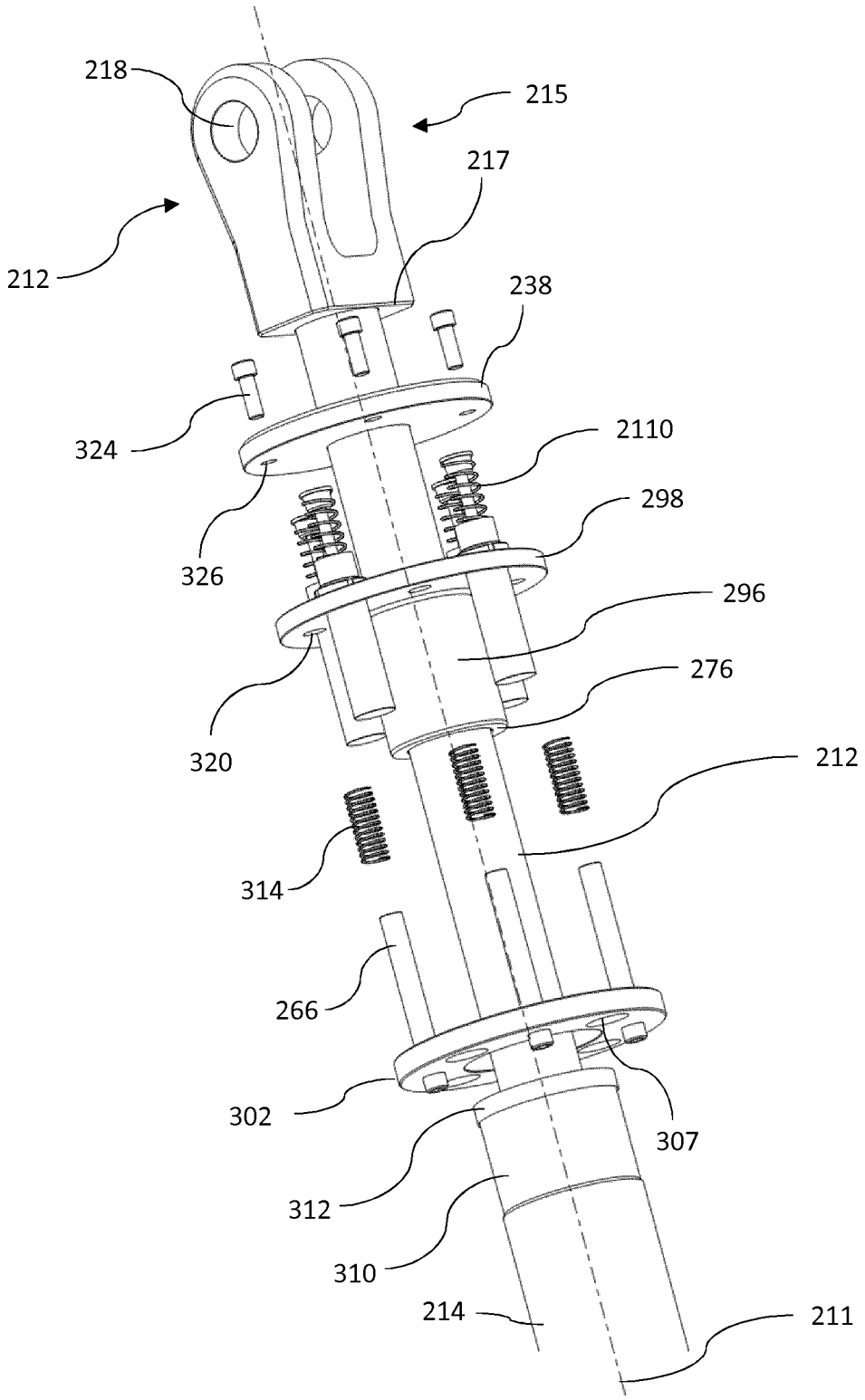
FIG. 11 is an exploded perspective view of the snubbing device shown in FIGS. 6 to 10.

FIG. 10 shows the actuator 210 in a retracted position, with the first end 215 of the actuator rod/piston 212 proximal to the first end 219 of the housing 214. The actuator rod/piston 212 is retracted to a greater extent than shown in FIG. 7, such that the snubber 228 is compressed (and therefore energised) as discussed below.

In this position, the stop 217 at the first end 215 of the actuator rod or piston 212 pushes against the first end 2111 of the snubber 2110. The flange 298 of the second frame part housing 264 is in abutting engagement with the flange 312 of the housing 214, thereby preventing the second frame part 236 from moving in the retraction direction of the actuator rod/piston 212 (i.e. to the left with respect to the orientation shown in FIG. 10). As a result, the snubber 2110 is compressed between flange 298 of the second frame part 234 and the first stop member 238. As shown in FIG. 10, a portion of the snubber 2110 extends within through-hole 307 in the second stop member 302.

As described above, the energy absorbing/storing element 314 is preferably dimensioned so as to be equal to or less than the distance between the first end 274 of the second frame part housing 264 and the second face 244 of the first stop member 238 when the actuator is in a settled or neutral position. Accordingly, in the compressed position shown in FIG. 10, the energy absorbing/storing element 314 is compressed between the first end 274 of the second frame part housing 264 and the second face 244 of the first stop member 238.

As shown in FIG. 10, the energy absorbing/storing element 314 is a spring, which at least partially stores energy during compression. Alternatively, energy absorbing/storing element 314 is a crush tube as described above, which deforms under compression between the first end 274 of the second frame part housing 264 and the second face 244 of the first stop member 238, thus absorbing energy. The material and thickness of the crush tube can be chosen according to the desired energy absorption characteristic of the snubber assembly 228 for the particular application for which the actuator 210 is used. The crush tube can be made of any material exhibiting plastic deformation properties and suitable crush characteristics. Preferred materials for the crush tube include stainless steel, aluminium and engineering plastic.

During normal operation of the actuator 210, the actuator rod/piston 212 moves within the housing 214 as the actuator 210 extends and contracts. When the actuator 210 is in a neutral (or "settled") position as shown in FIG. 7 (neither fully extended nor fully compressed), the snubber 2110 is not compressed and the snubber assembly 228 is not energised. The relative dimensions of the components of the snubber assembly 228 described above are such that, during normal operation:

- the second stop member 302 and the flange 298 of the second frame part housing 264 abut the flange 312 of the housing 214 from opposing sides (as shown in FIG. 7); and
- the first end 2111 of the snubber 2110 abuts the first stop member 238.

Therefore, the position of the snubber assembly 228 relative to the housing 214 remains substantially constant during normal operation. Similarly, the position of the snubber assembly 228 relative to the first end 215 of the actuator rod/piston 212 changes as the position of the first end 15 of the actuator rod/piston 12 changes relative to the first end 19 of the housing 14.

The first frame part 32 and the second frame part 34 are able to move circumferentially with respect to the housing 14.

In the event of a sudden expansion of the actuator 210 such that the actuator 210 is in the extended position shown in FIGS. 8 and 9, the first surface 227 of the flange/stop 221 at the second end 216 of the actuator rod/piston 212 pushes against the second end 276 of the housing 264 of the second frame part 234. In this situation, the snubber 2110 absorbs energy and cushions the movement of the actuator 210 by being compressed. The second frame part 234 moves away from the second stop member 302, the second stop member being in abutting engagement with flange 312 of the housing 214, thus compressing the snubber 2110 between the flange 298 of the second frame part 234 and the first stop member 238.

Similarly, in the event of a sudden compression of the actuator 210 such that the actuator 210 is in the retracted position shown in FIG. 10, the stop 217 of the first end 215 of the actuator rod/piston 212 is in abutting engagement with the first stop member 238, and the flange 298 of the second frame part 234 is in abutting engagement with the flange 312 of the housing 214. Again, the snubber 2110 absorbs energy and cushions the movement of the actuator 210 by being compressed between the flange 298 of the second frame part 234 and the first stop member 238.

In this way, the snubber assembly 228 provides bidirectional end-of-stroke damping. Put differently, the snubber assembly 228 damps motion of the actuator rod/piston 212 at both ends of its stroke—when nearly fully extended, further extension of the actuator rod 212 from the housing 214 is damped, and when nearly fully retracted, further retraction of the actuator rod 212 into the housing 214 is damped.

Therefore, in more general terms, both the first embodiment described with reference to FIGS. 1 to 5 and the second embodiment described with reference to FIGS. 7 to 11 include: an actuator rod/piston 12, 212 having a first end 15, 215 and a second end 16, 216 distal to the first end 15, 215; a housing 14, 214 having a first end 19, 219; and a snubber assembly 28, 228 having a first frame part 32, 232 and a second frame part 34, 234. In both embodiments: the actuator rod 12, 212 comprises a first stop 17, 217 at the first end 25, 215 of the actuator rod 12, 212 and a second stop 21, 221 at the second end 16, 216 of the actuator rod 12, 212; the housing 14, 214 comprises a third stop 36, 312 at the first end 19, 219 of the housing 14, 214; the first frame part 32, 232 includes a fourth stop 38, 238 configured to engage with the first stop 17, 217 and a seventh stop 54, 302 configured to engage with the third stop 36, 312; and the second frame part 34, 234 includes fifth stop 76, 276 configured to engage with the second stop 21, 221, and a sixth stop 98, 298 configured to engage with the third stop 36, 312. In the first embodiment described above, the second frame part 34 further includes an eighth stop 62 configured to engage with snubber 110.

Both the first and second embodiments above advantageously provide bidirectional end-of stroke damping in a single unit at one end of an actuator housing. The system is thus less complex that buffers requiring mechanical/hydraulic/electric etc. units at both ends of the actuator housing to provide bidirectional end-of-stroke damping. The embodiments above also provide energy absorption devices positioned offset to the axis of the actuator rod/piston, facilitating easy inspection and disassembly of the snubber assembly in situ, without the need to disassemble the actuator itself. Moreover, both the embodiments above allow the actuator rod to extend/retract through its full range of normal travel without ever energising the snubber assembly (i.e. the snubber assembly is only energised if the actuator rod moves to an extreme end of its stroke outside its normal operating range)—the embodiments above thus allow for reduced wear on the snubber assembly as compared to systems that require energising of a damping unit during normal operation (i.e. during the normal stroke range of an actuator rod).

Both the embodiments above also provide an improved means for utilising crush tubes for end-of-stroke damping in actuators (for example around rods 66, 266 as described above). Crush tubes are typically single use, plastically deformable elements that, once compressed, require replacement. The snubber assemblies described above beneficially allow such crush tubes to be easily replaced without having to disassemble the actuator itself—other systems that employ crush tubes positioned around an actuator rod itself (e.g. sharing the same axis as the actuator rod) necessitate disassembly of the actuator itself to replace the crush tube after compression.

Whilst both embodiments are advantageous over known systems, the second embodiment is preferred because it is mechanically less complex, making it easier to manufacture and easier to disassemble (without disassembling the actuator itself) when in situ (for example in the event that a component part of the snubber assembly requires maintenance, repair or replacement).

Figure 12:
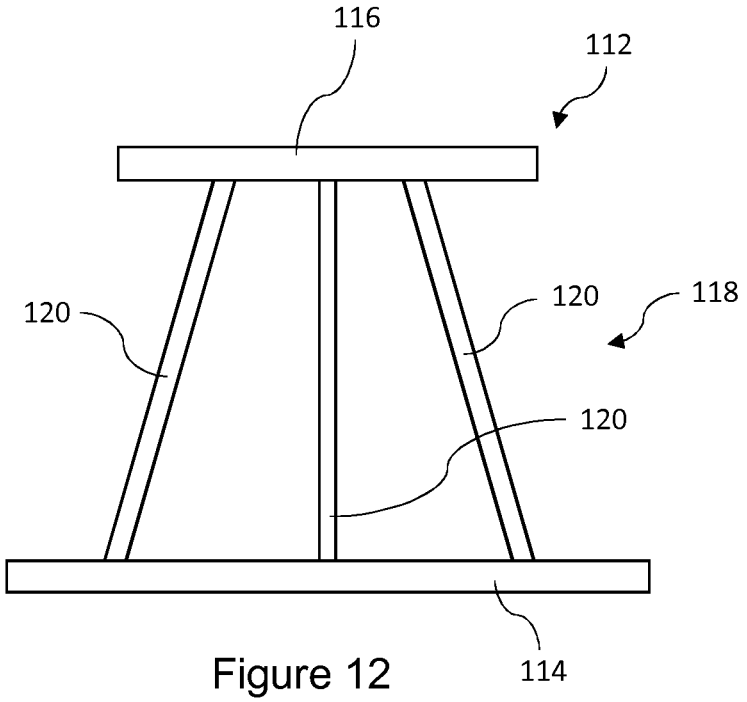
FIG. 12 is a schematic representation of a simulator or test system structure including an actuator according to the invention.

Referring now to FIG. 12, there is a schematic representation of a simulator or test system 112.

The simulator or test system 112 has a base 114, a platform 116 that is mounted for movement relative to the base 114, and an actuation mechanism 118. The actuation mechanism 118 is operatively arranged between the base 114 and the platform 116. The actuator mechanism 118 includes a number of actuators 120. At least one of the actuators 120 is an actuator as described above in relation to either the first or second embodiment and includes an actuator rod (for example in the case of an electromechanical actuator) or piston (for example, in the case of a hydraulic actuator) 12, 212 a housing 14, 214 and a snubber assembly 28, 228.

The simulator or test system 112 may, for example, be a single axis test system, a multi axis test system, an entertainment system or ride or simulator, an aircraft test system or simulator, an automotive test system or simulator or a hexapod.

In the embodiments described above, the snubber 110, 2110 includes a spring. It will be understood that, in alternative embodiments, the snubber may include any conventional off the shelf damper or snubber.

In the embodiments shown, the snubber assembly 28, 228 includes three dampers or snubbers. It will be understood that, in alternative embodiments, the snubber assembly 28, 228 may include a single damper or snubber. It will also be understood that, in other embodiments, the snubber assembly 28 may include any number of dampers or snubbers, such that the damping properties of the snubber assembly 28 can be tailored to the application of the actuator.

In the first embodiment shown, the snubber assembly 28, 228 includes three guidance rods 66, and in the second embodiment shown the snubber assembly 228 includes four guidance rods 266. It will be understood that the number of guidance rods may be changed according to the application of the actuator and the available space envelope. Accordingly, the snubber assembly of either embodiment above may, in some examples, include three or less or four or more guidance rods. Moreover, in embodiments utilising crush tubes positioned around the rods 66, 266, the number of rods can be chosen according to the crush properties of the crush tubes, such that the snubber assembly 28, 228 provides appropriate energy absorbing characteristics for the particular application of the actuator.

Likewise, in the first embodiment shown, the snubber assembly 28, 228 includes three snubbers 110, and in the second embodiment shown the snubber assembly 228 includes four snubbers 2110. It will be understood that the number of snubbers may be changed according to the application of the actuator and the available space envelope. Accordingly, the snubber assembly of either embodiment above may, in some examples, include three or less or four or more snubbers.

In a variation of the second embodiment shown, there may be no snubber 2110 provided, and the snubber assembly 228 can instead rely on damping provided by energy absorbing and/or storing elements 314.

In the first embodiment shown, the buffer bushing 40 and the snubber 110 are provided as separate components. It will be appreciated that these components may be provided as or in a single part in other embodiments of the invention.

The embodiments shown include clevis joints at first ends 15, 215 of the piston/actuator rod 12, 212, and at second ends of the housing 14, 214. It will be understood that different types of joints (for example universal joints) may be provided according to the requirements of the system in which the actuator 10, 210 is to be implemented.

The following numbered statements provide further examples of the present disclosure:

1. An actuator including a housing, a piston and a snubber assembly; wherein the snubber assembly is mounted at one end of the housing.

2. An actuator according to statement 1, wherein the actuator has an axis, the snubber assembly includes an energy absorbing device, and the snubber assembly is positioned on the housing such that an axis of the energy absorbing device is offset relative to the axis of the actuator.

3. An actuator according to statement 2, wherein the snubber assembly includes a frame that is configured to receive the energy absorbing device.

4. An actuator according to statement 3, wherein the energy absorbing device is a damper.

5. An actuator according to statement 4, wherein the damper is a mechanical damper.

6. An actuator according to statement 4 or statement 5, wherein the damper is a bidirectional end-of-stroke damper.

7. An actuator according to statement 3, statement 4, statement 5 or statement 6, wherein the frame is configured to receive more than one energy absorbing device.

8. An actuator according to any of statements 3 to 7, wherein the frame includes a first frame part and a second frame part, and the or each energy absorbing device is positioned between the first frame part and the second frame part.

9. An actuator according to statement 8, wherein the first frame part includes a stop member and a mounting member.

10. An actuator according to statement 9, wherein the first frame part mounting member is configured to receive the energy absorbing device.

11. An actuator according to statement 8, statement 9 or statement 10, wherein the second frame part includes a stop member, a housing and a rod. 12. An actuator according to statement 11, wherein the rod extends between the second frame part stop member and the second frame member housing.

13. An actuator according to statement 11 or statement 12, when dependent on statement 9 or 10, wherein the second frame member housing includes an opening that is configured to receive the first frame part mounting member.

14. An actuator according to statement 13, further including a ring member, wherein the ring member is positioned between the first frame part stop member and the second frame part stop member.

15. A simulator or test system including a base, a platform that is mounted for movement relative to the base, and an actuation mechanism that is operatively arranged between the base and the platform, wherein the actuation mechanism includes at least one actuator as defined by any of statements 1 to 14.

The invention claimed is:

1. An actuator, comprising:

a housing having a first end, wherein an aperture is positioned at the first end of the housing;

an actuator rod extending through the aperture along an axis of the actuator, the actuator rod operable to be driven with a bidirectional stroke, wherein the bidirectional stroke comprises an operational range and an end-of-stroke range; and a snubber assembly mounted at the first end of the housing, wherein the snubber assembly includes one or more energy absorbing devices, and the snubber assembly is positioned on the housing such that an axis of each of the one or more energy absorbing devices is offset relative to the axis of the actuator, wherein the snubber assembly is configured such that the one or more energy absorbing devices provide bidirectional damping to the end-of-stroke range motion of the actuator rod, wherein the snubber assembly includes a frame that is configured to receive the one or more energy absorbing devices, wherein the frame includes a first frame part and a second frame part, and the one or more energy absorbing devices are positioned between the first frame part and the second frame part, wherein the first frame part is moveable relative to the second frame part along the axis of the actuator, and the first frame part and the second frame part are moveable relative to the housing along the axis of the actuator.

2. The actuator according to claim 1, wherein the snubber assembly is configured such that:

the one or more energy devices compress to provide damping at the end of an extension stroke of the actuator rod;

the one or more energy devices compress to provide damping at the end of a retraction stroke of the actuator rod.

3. The actuator according to claim 1, wherein at least one of the one or more energy absorbing devices is selected from: a damper, a spring, a crush tube, and a plastically deformable material.

4. The actuator according to claim 1, wherein:

the actuator rod has a first end and a second end distal to the first end;

the actuator rod comprises a first stop at the first end of the actuator rod and a second stop at the second end of the actuator rod;

the housing comprises a third stop at the first end of the housing;

the first frame part includes a fourth stop configured to engage with the first stop and a seventh stop configured to engage with the third stop; and the second frame part includes a fifth stop configured to engage with the second stop, and a sixth stop configured to engage with the third stop.

5. The actuator according to claim 4, wherein when the actuator rod is extended from the housing to a first predetermined extension distance:

the second stop is brought into abutting engagement with the fifth stop;

the seventh stop abuts the third stop thereby preventing motion of the first frame part in the direction of the extension of the actuator rod;

further extension of the actuator rod causes the second frame part to move in the direction of extension of the actuator rod, thereby compressing the one or more energy absorbing devices between the first frame part and the second frame part.

6. The actuator according to claim 5, wherein when the actuator rod is retracted into the housing to a second predetermined extension distance:

the first stop is brought into abutting engagement with the fourth stop;

the second stop abuts the third stop thereby preventing motion of the second frame part in the direction of the retraction of the actuator rod;

further retraction of the actuator rod causes the first frame part to move in the direction of retraction of the actuator rod, thereby compressing the one or more energy absorbing devices between the first frame part and the second frame part.

7. The actuator according to claim 4, wherein:

the first frame part comprises a rod linking the fourth stop and the seventh stop;

a first energy absorbing device of the one or more energy absorbing devices is a crush tube or spring surrounding a portion of the rod;

the first energy absorbing device is positioned between the first frame part and the second frame part; and the first energy absorbing device is positioned between the fourth stop and the sixth stop.

8. The actuator according to claim 4, wherein:

the second frame part includes an eighth stop configured to engage with the one or more energy absorbing devices; and in use, when the actuator rod is extended from the housing to a first predetermined extension distance:

the eighth stop abuts the one or more energy absorbing devices;

the further extension of the actuator rod causes compression of the one or more energy absorbing devices between the first frame part and the eighth stop.

9. The actuator according to claim 8, wherein when the actuator rod is retracted into the housing to a second predetermined extension distance:

the eighth stop abuts the one or more energy absorbing devices;

the further retraction of the actuator rod causes compression of the one or more energy absorbing devices between the first frame part and the eighth stop.

10. The actuator according to claim 4, wherein the second frame part includes a housing, a rod and an eighth stop configured to engage with the one or more energy absorbing devices and the rod extends between the eighth stop and the second frame member housing.

11. The actuator according to claim 10, wherein:

a first energy absorbing device of the one or more energy absorbing devices is a crush tube or spring surrounding a portion of the rod; and the first energy absorbing device is positioned between the eighth stop and the third stop.

12. The actuator according to claim 10, wherein:

the first frame part includes a mounting member;

the second frame member housing includes an opening that is configured to receive the first frame part mounting member;

the third stop is a ring member; and the ring member is positioned between the fourth stop and the eighth stop.

13. The actuator according to claim 1, wherein the first frame part includes a mounting member configured to receive the energy absorbing device.

14. An actuator, comprising:

a housing having a first end and an aperture positioned at the first end of the housing;

an actuator rod extending through the aperture along an axis of the actuator, the actuator rod operable to be driven with a bidirectional stroke, wherein the actuator rod has an operational range and at least one end-of-stroke extension range; and a snubber assembly mounted at the first end of the housing, wherein the snubber assembly includes one or more energy absorbing devices, and the snubber assembly is positioned on the housing such that an axis of each of the one or more energy absorbing devices is offset relative to the axis of the actuator, wherein the one or more energy absorbing devices are configured to prevent the actuator rod entering the at least one end-of-stroke extension range during controlled operation of the actuator, wherein the one or more energy absorbing devices are configured to deform, thereby allowing the actuator rod to enter the at least one end-of-stroke extension range, absorbing energy and damping motion of the actuator rod in the event of uncontrolled operation of the actuator, wherein the snubber assembly includes a frame that is configured to receive the one or more energy absorbing devices, and the frame includes a first frame part and a second frame part, and the one or more energy absorbing devices are positioned between the first frame part and the second frame part, wherein the first frame part is moveable relative to the second frame part along the axis of the actuator, and the first frame part and the second frame part are moveable relative to the housing along the axis of the actuator.

15. The actuator according to claim 14, wherein:

during controlled operation of the actuator, the actuator rod exerts a maximum force on the energy absorbing device less than a threshold force;

during uncontrolled operation of the actuator, the actuator rod exerts a maximum force on the energy absorbing device equal to or greater than the threshold force; and the one or more energy absorbing devices are configured to deform when a force equal to or greater than the threshold force is applied to the one or more energy absorbing devices.

16. The actuator according to claim 15, wherein each of the at least one energy absorbing devices is a crush tube.

17. The actuator according to claim 14, wherein the snubber assembly is configured to provide bidirectional end-of-stroke damping such that:

the one or more energy absorbing devices are configured to prevent the actuator rod entering a first end-of-stroke extension range corresponding to an extended position of the actuator rod and a second end-of-stroke extension range corresponding to a retracted position of the actuator rod during controlled operation of the actuator; and the one or more energy absorbing devices are configured to deform, thereby allowing the actuator rod to enter either the first end-of-stroke extension range or the second end-of-stroke extension range in the event of uncontrolled operation of the actuator.

18. The actuator according to claim 14, wherein:

the actuator rod has a first end and a second end distal to the first end;

the actuator rod comprises a first stop at the first end of the actuator rod and a second stop at the second end of the actuator rod;

the housing comprises a third stop at the first end of the housing;

the first frame part includes a fourth stop configured to engage with the first stop and a seventh stop configured to engage with the third stop; and the second frame part includes a fifth stop configured to engage with the second stop, and a sixth stop configured to engage with the third stop.

19. The actuator according to claim 18 wherein in use, when the actuator rod is extended from the housing to a first predetermined extension distance:

the second stop is brought into abutting engagement with the fifth stop;

the seventh stop abuts the third stop thereby preventing motion of the first frame part in the direction of the extension of the actuator rod;

further extension of the actuator rod during uncontrolled operation causes the second frame part to move in the direction of extension of the actuator rod, thereby compressing and deforming the one or more energy absorbing devices between the first frame part and the second frame part.

20. The actuator according to claim 18 wherein in use, when the actuator rod is retracted into the housing to a second predetermined extension distance:

the first stop is brought into abutting engagement with the fourth stop;

the second stop abuts the third stop thereby preventing motion of the second frame part in the direction of the retraction of the actuator rod;

further retraction of the actuator rod during uncontrolled operation causes the first frame part to move in the direction of retraction of the actuator rod, thereby deforming and compressing the one or more energy absorbing devices between the first frame part and the second frame part.

21. A simulator or test system, comprising:

a base, a platform that is mounted for movement relative to the base, and an actuation mechanism including at least one actuator comprising:

a housing having a first end, wherein an aperture is positioned at the first end of the housing;

an actuator rod extending through the aperture along an axis of the actuator, the actuator rod operable to be driven with a bidirectional stroke, wherein the bidirectional stroke comprises an operational range and an end-of-stroke range; and a snubber assembly mounted at the first end of the housing, wherein the snubber assembly includes one or more energy absorbing devices, and the snubber assembly is positioned on the housing such that an axis of each of the one or more energy absorbing devices is offset relative to the axis of the actuator, wherein the snubber assembly is configured such that the one or more energy absorbing devices provide bidirectional end-of-stroke range damping to motion of the actuator rod, wherein the snubber assembly includes a frame that is configured to receive the one or more energy absorbing devices, wherein the frame includes a first frame part and a second frame part, and the one or more energy absorbing devices are positioned between the first frame part and the second frame part, wherein the first frame part is moveable relative to the second frame part along the axis of the actuator, and the first frame part and the second frame part are moveable relative to the housing along the axis of the actuator, wherein the actuation mechanism is operatively arranged between the base and the platform.

* * * * *